United States Patent [19]

Morales

[11] 4,184,098

[45] Jan. 15, 1980

[54] CONE TYPE DYNODE FOR PHOTOMULTIPLIER TUBE

[75] Inventor: John J. Morales, Huntington, Conn.

[73] Assignee: S.R.C. Laboratories, Inc., Fairfield, Conn.

[21] Appl. No.: 878,031

[22] Filed: Feb. 15, 1978

Related U.S. Application Data

[63] Continuation of Ser. No. 679,339, Apr. 22, 1976, abandoned, and a continuation-in-part of Ser. No. 544,016, Jan. 24, 1975, Pat. No. 3,959,680.

[51] Int. Cl.[2] ..... H01J 39/14; H01J 43/08

[52] U.S. Cl. ..... 313/95; 313/105 R

[58] Field of Search ..... 313/95, 103 CM, 103 R, 313/104, 105 R, 105 CM, 365, 373, 377, 379

[56] References Cited

U.S. PATENT DOCUMENTS

| | | | |
|---|---|---|---|
| 2,133,132 | 10/1938 | Clamann | 313/95 X |
| 2,160,798 | 5/1939 | Teal | 313/105 |
| 2,197,652 | 4/1940 | Statz et al. | 313/103 X |
| 2,216,282 | 10/1940 | Schwartz et al. | 313/105 |
| 2,245,614 | 6/1941 | Shockley | 313/105 |
| 2,433,941 | 1/1948 | Weimer | 313/377 |
| 2,586,482 | 2/1952 | Rose | 313/365 X |
| 2,682,479 | 6/1954 | Johnson | 313/373 X |
| 2,872,721 | 2/1959 | McGee | 313/105 CM |
| 2,942,133 | 6/1960 | McGee | 313/105 R X |
| 3,060,343 | 10/1962 | Goff et al. | 313/377 X |
| 3,207,997 | 9/1965 | Eberhardt | 313/95 X |

FOREIGN PATENT DOCUMENTS

| | | | |
|---|---|---|---|
| 227470 | of 1943 | Switzerland | 328/243 |

OTHER PUBLICATIONS

Zworykin et al, "Television," 2d edition; John Wiley & Sons, Inc.; New York, 1954; p. 365 cited.

*Primary Examiner*—Robert Segal
*Attorney, Agent, or Firm*—Ernest M. Junkins

[57] ABSTRACT

A dynode for use as a stage of a plural stage photomultiplier tube in which the dynode is formed of a plurality of axially and planarly aligned conical frustums.

10 Claims, 6 Drawing Figures

CONE TYPE DYNODE FOR PHOTOMULTIPLIER TUBE

This is a continuation of application Ser. No. 679,339 filed Apr. 22, 1976 now abandoned, and is a continuation-in-part of application Ser. No. 544,016, filed Jan. 24, 1975 now U.S. Pat. No. 3,959,680.

In photomultiplier tubes either of the single or plural sensing area types, the latter being disclosed in my above-noted application, there are generally a plurality of electron multiplying stages. Each stage, generally called a dynode, receives electrons from a prior stage and by its relative electrical potential and electron emitting surface produces more electrons than it receives and which in turn are generally collected and multiplied by the next stage. The initial stage receives electrons from a cathode material upon which matter desired to be sensed inpinges, such as rays or particles, and which produces electrons in response thereto.

For an ideal operation, each cathode electron should be represented by an identical certain number of electrons collected at the anode of the tube. This requires that every electron that strikes one stage causes an identical multiplied number to be emitted and also that all emitted electrons be collected or strike the next stage. However, the number of emitted electrons that are collected by the next stage depends on, as one factor, the angularity on which they are emitted from the prior stage with respect to the location of the next stage. Thus, while heretofore noted photomultiplier tubes have operated, directional consistency of multiplication through the tube has not been achieved.

It is accordingly an object of the present invention to provide a dynode for photomultiplier tubes which tends to decrease the variation in operation that could be heretofore attributed to mechanical angularity of the dynode surfaces.

Another object of the present invention is to provide a photomultiplier tube having at least two successive dynodes or stages in which the tendency of the electrons being emitted from the first dynode to not strike the second dynode is reduced.

A further object of the present invention is to achieve the above objects with a dynode that is capable of being relatively economically produced and which is usable on currently available photomultiplier tubes without substantial change therein.

In carrying out the present invention, there is provided a dynode for a photomultiplier tube that is formed of a plurality of frustums of cones that are in turn each formed from thin sheet metal. The frustums are of essentially equal height and angularity, are positioned coaxially and are made to be of diameters which enable them to be essentially equally spaced apart when assembled into a dynode. Either prior to or after assembly, the surfaces of the frustums are covered with an electron emissive coating in the same manner as heretofore known dynodes.

Preferably the tube is provided with a plurality of such herein disclosed dynodes with the first dynode having its frustums positioned to diverge from the tube's axis while the next dynode has its frustums inverted so as to essentially converge along the axis of the tube towards the anode. If there is a next stage, the dynodes' position and construction is similar to the first so that in the plural stage tube, the dynodes will alternate between diverging and converging frustums. If only one of the herein disclosed dynodes is employed, it is preferred to utilize it as the first dynode that receives the cathode electrons.

Other features and advantages will hereinafter appear.

In the drawing -

Figure 1:
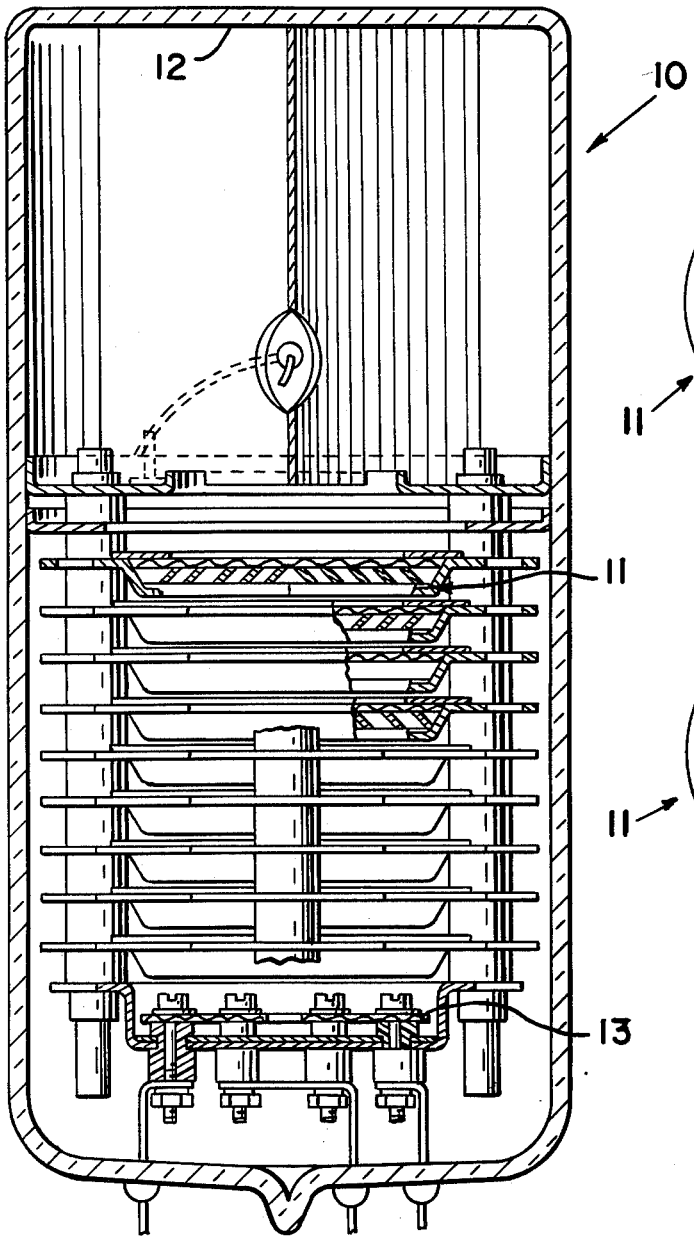
FIG. 1 is an essentially axial section of a plural stage photomultiplier tube having the dynode of the present invention incorporated only in the first stage thereof.
Figure 2:
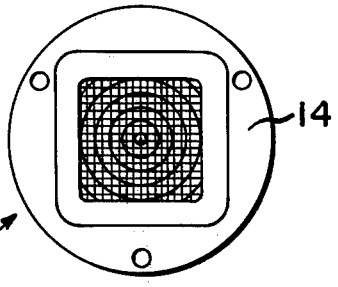
FIG. 2 is a top view of the first dynode.
Figure 3:
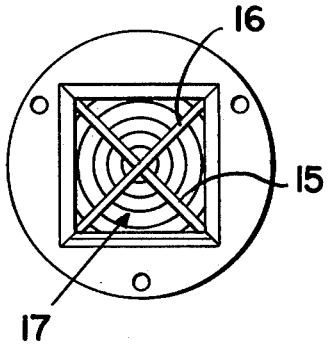
FIG. 3 is a bottom view thereof.

Referring to the drawing, a photomultiplier tube 10 of the type disclosed in my above-noted U.S. application includes a dynode 11 constructed according to the present invention. The multiplier tube has cathode material 12 for receiving particles or rays to be sensed and which emits electrons in response thereto. These cathode electrons strike and are initially multiplied by the dynode 11 and by the subsequent dynodes in the stack thereof. An anode 13 collects the multiplied electrons to provide an electrical representation of the quantity of sensed matter impinging upon the tube 10.

Other than the dynode 11, the remaining dynodes in the stack of this tube 10 have a general construction which is referred to in the art as venetian blind or straight slat type dynodes. While the present invention is disclosed with respect to a plural sensing area tube, it will be understood that the invention is not to be limited thereto but is equally applicable to single area photomultiplier tubes. For a more complete description of the tube 10, reference is made to my copending application.

The dynode 11 includes a base plate 14 having a pair of intersecting thin bars 15 and 16 which support a plurality of frustums of cones 17 on the plate 14. The cones 17, as shown in FIG. 1, are essentially of equal height and have diameters which enable them to be essentially equally spaced laterally of the axis of the tube. The cones are formed preferably of sheet metal and covered with electron emissive material such that upon being struck by an electron, the material will emit a plurality of electrons which are then attracted to strike the next stage as is well known in the art. If desired, the coating may be eliminated if electron emitting sheet metal is used.

Figure 4:
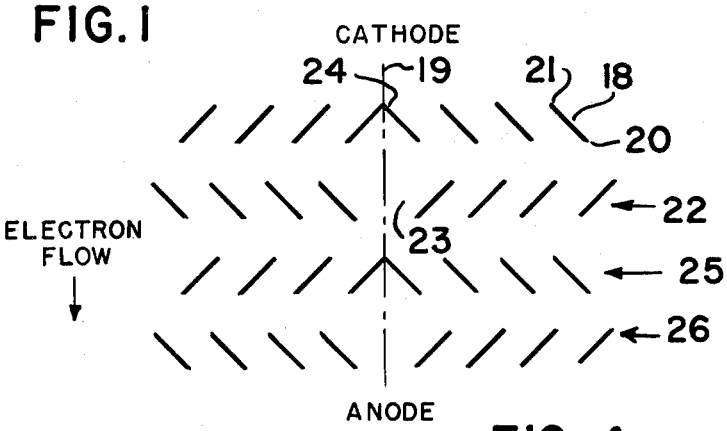
FIG. 4 is a diagrammatic representation of the alignment and arrangement of a plurality of dynodes in a plural stage tube.

While the tube 10 has only the first dynode formed with frustums of cones, the present invention contemplates forming a photomultiplier tube with a plurality of cone type dynodes such as the dynode 11. Thus, as diagrammatically shown in FIG. 4, it is initially desired to have a first cone type dynode 18 have its frustums diverge from the axis 19 of the tube so that the base 20 of the frustum nearest the anode is larger than the top 21 of each frustum nearest the cathode. The next dynode indicated by the reference character 22 is inverted, in the sense that the larger bases of the frustums are located nearer the cathode than the anode. It will also be noted, that with the converging dynode 22, the frustums are somewhat larger in diameter than those in the diverging dynode 18. In addition the smallest frustum of the converging dynode will have an opening indicated by the reference character 23 therein while in the diverging dynode 18, the smallest frustum may have an apex 24.

For subsequent dynode stages, the diverging dynode 18 and the converging dynode 22 are alternated so the next dynode 25 will be identical in construction to the dynode 18 while the following dynode 26 will be of construction identical to the dynode 22. If desired, the first dynode may be converging rather than diverging.

Figure 5:
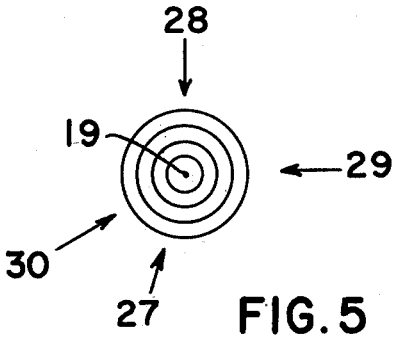
FIG. 5 is a diagrammatic plan representation showing possible directions electrons may strike a dynode of the present invention.

Preferably the converging frustums of the dynode 22 have an uppr diameter, i.e., their larger diameter, which aligns their upper edges along the axis of the tube with essentially the mid-point between the bases of the frustums located in the diverging dynode immediately there-above. Also the smaller diameter of the converging dynode frustums are aligned essentially with the mid-points between the upper ends of the frustums in the succeeding diverging dynode. This enables the outer frustum of a converging dynode to have an inner surface which extends slightly beyond the outer surface of the diverging dynode. Though electrons move generally along the axis of the tube, they also generally have some component of movement laterally or perpendicular to the tube axis. This applies to both electrons emitted from the cathode and also from the dynodes. The present invention tends to decrease the effect of the lateral movement of the electrons by essentially assuring a surface for an electron to impinge upon. As shown in FIG. 5, reference character 27 denoted a plan view of a conical type dynode and arrows 28, 29 and 30 indicate possible transverse directions that electrons may have. It will be seen that irrespective of which lateral direction an electron is moving transversely, it will strike against a dynode surface.

Figure 6:
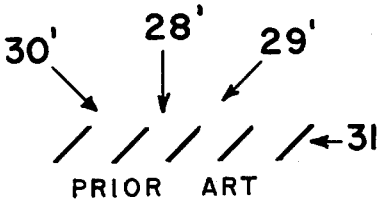
FIG. 6 is a diagrammatic side representation showing possible directions electrons may strike a prior art venetian blind, straight slat, type dynode.

Shown in FIG. 6 is a diagrammatic cross-section of a venetian blind, linear slat type dynode 31, (also denoted prior art) with again the three directions of movement 28', 29' and 30' being represented. It will be seen that electrons traveling in the direction of the arrow 30' will assuredly strike a dynode surface, while electrons traveling in the direction of the arrow 28' will probably strike a dynode surface while electrons traveling in the direction of the arrow 29' will probably not properly strike a dynode surface. The possibility that an electron not impinging properly on a dynode would tend to alter the repeatability and accuracy of the tube. This effect is especially noticeable when the dynode is the first dynode and the electron is emitted by the cathode. Further, in tubes wherein the first dynode is located nearer the cathode, the effect of lateral movement becomes more pronounced.

An electron when impinging on a dynode surface will cause electrons to be emitted with the emitted electrons having a probability of path direction that is generally perpendicular to the surface but yet normally includes lateral movement. Some electrons will have lateral movement towards the axis while electrons will have lateral movement towards the axis while others will have movement away from the axis. As to the latter, they impinge on the next dynode further from the tube axis and again there will be some emitted electrons having lateral movement away from the axis. As electrons which are traceable to or in effect fathered by a cathode electron, the lateral outward movement becomes accumulative and the path of such electrons spreads so that towards the lower dynodes, the path may extend beyond a dynode and the outermost electrons not impinge thereon. This is especially applicable to conventional single sensing area tubes having linear slat dynodes in which all the slats extend in the same lateral direction. The use of plural cone type dynodes tends to minimize the spreading by presenting an arcuate surface to the laterally moving electrons which tends to direct the emitted electrons toward the axis of the tube and hence supress the accumulation of lateral outward movement.

While the heretofore specifically disclosed frustums have been as being individual pieces, it is contemplated that at least portions of a plurality may be formed from a unitary piece of thin metal.

It will accordingly be understood that there has been disclosed a dynode composed of a plurality of frustums of cones that are coaxially positioned and transversely aligned. This dynode structure decreases the probability that it will emit a different number of electrons for each electron that impinges thereon. Further when such dynodes are utilized in successive stages of a photomultiplier tube with alternating diverging and converging frustums, such dynodes tend to increase the tendency that emitted electrons will impinge on a subsequent dynode.

Variations and modification may be made within the scope of the claims and portions of the improvements may be used without others.

I claim:

1. A photomultiplier tube having a single sensing area comprising an electron emitting cathode, an electron collecting anode spaced from the cathode and a plurality of electron multiplying dynodes positioned between the cathode and anode, at least one of said dynodes comprising at least three different size frustums of cones formed of thin metal, means mounting the frustums with their upper and lower edges lying in upper and lower parallel planes and concentric about an axis extending between the cathode and anode and including means electrically interconnecting each frustum to place them all at the same potential and means forming an electron emissive surface on the frustum, in which said one dynode is located to be the dynode nearest the cathode and in which the frustums are diverging to be inclined in a direction outwardly of the axis towards the anode.

2. The invention as defined in claim 1 in which there is at least another dynode with said another dynode comprising at least three different size frustums of cones formed of thin metal, means mounting the frustums with their upper and lower edges lying in upper and lower parallel planes and concentric about the said axis and including means electrically interconnecting each frustum to place them all at the same potential and means forming an electron emissive surface on the frustums, said another dynode having its frustums converge to be inclined in a direction inwardly of the axis towards the anode.

3. A photomultiplier tube having a single sensing area comprising an electron emitting cathode, an electron collecting anode spaced from the cathode, and a plurality of electron multiplying dynodes positioned between the cathode and anode, at least one of said dynodes comprising at least three different size circular elements, means mounting the elements with their upper and lower edges lying in upper and lower parallel planes and concentric about an axis extending between the cathode and anode and including means for electrically interconnecting the plurality of elements to be at the same potential and means forming an electron emissive surface on at least one of the surfaces of the elements, and in which the one dynode is the dynode nearest the cathode.

4. The invention as defined in claim 3 in which there is at least another dynode with said another dynode comprising at least three different size circular elements formed of thin metal, means mounting the elements with their upper and lower edges lying in upper and lower parallel planes and concentric about the said axis and including means electrically interconnecting each element to place them all at the same potential and means forming an electron emissive surface on the elements, said another dynode being adjacent the anode side of the one dynode to receive electrons therefrom and in which the diameters of the elements of the another dynode are slightly larger than the diameters of the corresponding elements of the one dynode.

5. A photomultiplier tube having a single sensing area comprising an electron emitting cathode, an electron collecting anode spaced from the cathode and a plurality of electron multiplying dynodes positioned between the cathode and anode, at least one of said dynodes comprising at least three different size frustums of cones formed of thin metal, means mounting the frustums with their upper and lower edges lying in upper and lower parallel planes and concentric about an axis extending between the cathode and anode and including means electrically interconnecting each frustum to place them all at the same potential and means forming an electron emissive surface on the frustums; and in which there is at least another dynode with said another dynode comprising at least three different size frustums of cones formed of thin metal, means mounting the frustums with their upper and lower edges lying in upper and lower parallel planes and concentric about the said axis and including means electrically interconnecting each frustum to place them all at the same potential and means forming an electron emissive surface on the frustums, said another dynode having its frustums converge to be inclined in a direction inwardly of the axis towards the anode; and in which said another dynode is adjacent the anode side of the one dynode to receive electrons therefrom and in which the diameters of the frustums of the another dynode are slightly larger than the diameters of the corresponding frustums of the one dynode.

6. A photomultiplier tube having a single sensing area comprising an electron emitting cathode, an electron collecting anode spaced from the cathode and a plurality of electron multiplying dynodes positioned between the cathode and anode, at least one of said dynodes comprising at least three different size frustums of cones formed of thin metal, means mounting the frustums with their upper and lower edges lying in upper and lower parallel planes and concentric about an axis extending between the cathode and anode and including means electrically interconnecting each frustum to place them all at the same potential and means forming an electron emissive surface on the frustums: and in which there is at least another dynode with said another dynode comprising at least three different size frustums of cones formed of thin metal, means mounting the frustums with their upper and lower edges lying in upper and lower parallel planes and concentric about the said axis and including means electrically interconnecting each frustum to place them all at the same potential and means forming an electron emissive surface on the frustums, said another dynode having its frustums converge to be inclined in a direction inwardly of the axis towards the anode: and in which the mounting means for each dynode includes a pair of thin intersecting metallic strips having an intersection essentially coinciding with the axis.

7. A photomultiplier tube having a single sensing area comprising an electron emitting cathode, an electron collecting anode spaced from the cathode and a plurality of electron multiplying dynodes positioned between the cathode and anode, at least one of said dynodes comprising at least three different size frustums of cones formed of thin metal, means mounting the frustums with their upper and lower edges lying in upper and lower parallel planes and concentric about an axis extending between the cathode and anode and including means electrically interconnecting each frustum to place them all at the same potential and means forming an electron emissive surface on the frustums and in which the mounting means includes a pair of thin intersecting metallic strips having an intersection essentially coinciding with the axis.

8. The invention as defined in claim 7 in which the strips engage and support a corresponding end of each of the frustums.

9. A photomultiplier tube having a single sensing area comprising an electron emitting cathode, and electron collecting anode spaced from the cathode, and a plurality of electron multiplying dynodes positioned between the cathode and anode, at least one of said dynodes comprising at least three different size circular elements, means mounting the elements with their upper and lower edges lying in upper and lower parallel planes and concentric about an axis extending between the cathode and anode and including means for electrically interconnecting the plurality of elements to be at the same potential and means forming an electron emissive surface on at least one of the surfaces of the elements, and in which the one dynode is the dynode nearest the cathode and in which the mounting means includes a pair of thin intersecting metallic strips formed of electrically conducting material, in which the mounting means is interconnected to each element and in which the mounting means constitutes the electrical interconnecting means and in which the intersection of the strips essentially coincides with the axis.

10. A photomultiplier tube having a single sensing area comprising an electron emitting cathode, an electron collecting anode spaced from the cathode, and a plurality of electron multiplying dynodes positioned between the cathode and anode, at least one of said dynodes comprising at least three different size circular elements, means mounting the elements with their upper and lower edges lying in upper and lower parallel planes and concentric about an axis extending between the cathode and anode and including means for electrically interconnecting the plurality of elements to be at the same potential and means forming an electron emissive surface on at least one of the surfaces of the elements, and in which the one dynode is the dynode nearest the cathode and in which there is at least another dynode with said another dynode comprising at least three different size circular elements formed of thin metal, means mounting the elements with their upper and lower edges lying in upper and lower parallel planes and concentric about the said axis and including means electrically interconnecting each element to place them all at the same potential and means forming an electron emissive surface on the elements, said another dynode being adjacent the anode side of the one dynode to receive electrons therefrom and in which the diameters of the elements of the another dynode are slightly larger than the diameters of the corresponding elements of the one dynode.

* * * * *

UNITED STATES PATENT AND TRADEMARK OFFICE

CERTIFICATE OF CORRECTION

PATENT NO. : 4,184,098

DATED : January 15, 1980

INVENTOR(S) : JOHN J. MORALES

It is certified that error appears in the above-identified patent and that said Letters Patent are hereby corrected as shown below:

Col. 3, line 12, "uppr" should be --upper--; line 30, "denoted" should be --denotes--; lines 58-59 delete the phrase "while electrons will have lateral movement towards the axis"; col. 5, line 56 ":" should be --;-- and line 68 ":" should be --;--.

Signed and Sealed this

*Third* Day of *June 1980*

[SEAL]

*Attest:*

SIDNEY A. DIAMOND

*Attesting Officer*

*Commissioner of Patents and Trademarks*